US006442356B2

(12) United States Patent
Omata et al.

(10) Patent No.: US 6,442,356 B2
(45) Date of Patent: Aug. 27, 2002

(54) IMAGE FORMING APPARATUS

(75) Inventors: Haruhiko Omata, Susono; Yoichi Kimura, Numazu; Yoshikuni Ito, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/824,747

(22) Filed: Apr. 4, 2001

(30) Foreign Application Priority Data

Apr. 6, 2000 (JP) ..... 2000-105476

(51) Int. Cl.[7] ..... G03G 15/01; G03G 15/16
(52) U.S. Cl. ..... 399/66; 399/299; 399/302
(58) Field of Search ..... 399/66, 298, 299, 399/302, 314

(56) References Cited

U.S. PATENT DOCUMENTS 5,550,620 A 8/1996 Kimura et al. ..... 399/304
5,600,421 A 2/1997 Takekoshi et al. ..... 399/66
5,911,100 A 6/1999 Hasegawa et al. ..... 399/303
6,134,402 A * 10/2000 Nakayama et al. ..... 399/299 X
6,226,486 B1 5/2001 Itou et al. ..... 399/303
6,321,059 B1 * 11/2001 Tamura ..... 399/302 X

FOREIGN PATENT DOCUMENTS

JP 2001-83758 * 3/2001

* cited by examiner

*Primary Examiner*—Sophia S. Chen
(74) *Attorney, Agent, or Firm*—Fitzpatrick, Cella, Harper & Scinto

(57) ABSTRACT

An image forming apparatus of the type in which it is possible to select an image forming station for image formation from a plurality of image forming stations, includes: a plurality of image forming stations each having an image bearing member for bearing a latent image and a developing device for developing the latent image on the image bearing member by a developer; transfer members adapted to come into contact with a medium member to induce a charge and to electrostatically transfer developed images formed in the plurality of image forming stations to the medium member; and a current control portion for controlling an electric current flowing through the transfer members, wherein the current control portion effects control such that no electric current flows through the transfer member corresponding to an image forming station not being used for image formation.

28 Claims, 6 Drawing Sheets

IMAGE FORMING APPARATUS

BACKGROUND OF THE INVENTION

1 Field of the Invention

The present invention relates to an image forming apparatus, such as an electrophotographic copying machine and a laser printer.

2. Related Background Art

A color image forming apparatus is known which comprises an endless recording material bearing member bearing a recording material on its surface and conveying it, and a plurality of image forming stations (for example, four image forming stations for forming yellow, magenta, cyan and black toner images) arranged along the direction in which the recording material bearing member moves.

In the above-mentioned image forming apparatus, toner images of different colors are formed on the respective photosensitive drums (image bearing members) of the image forming stations by primary chargers, exposure devices, and developing devices. These toner images are sequentially transferred to the recording material on the transfer belt (recording material bearing member) by applying transfer bias to a transfer charger arranged in each image forming station, and are then superimposed on the recording material. Thereafter, the toner images are fixed to the recording material to obtain a color image.

In some image forming apparatuses of this type, when the image to be formed is a full-color image, the processing devices of all of the four image forming stations, such as the primary chargers, exposure devices, and developing devices are operated to form a color image, whereas, when the image to be formed is a monochrome image, the operation of the primary chargers, developing devices, etc. of the image forming stations other than that for forming black images, i.e., the image forming stations for forming yellow, magenta, and cyan images, is stopped to thereby reduce deterioration in the primary chargers, developing devices, photosensitive drums, etc., thereby achieving a long service life. In other image forming apparatuses of this type, the color features of the original image, for example, are detected beforehand, and in one to three image forming stations (for one to three colors) of the four image forming stations, which are not used for image formation, the developing devices are stopped.

However, when, as mentioned above, image formation is performed, with the operation of the processing devices being stopped in some of the image forming stations, transfer charging is also effected in the image forming stations whose processing devices are not working when the transfer chargers of all the image forming stations are operated as in the case of the formation of a full-color image, with the result that memory is generated on the photosensitive drums or the potential of the transfer belt increases, resulting in a defective image.

To prevent this, when stopping the operation of a processing device, it might be possible to ground the transfer charger corresponding to the image forming station having that processing device. In that case, however, defective transfer can be caused in a high-humidity environment. This arises from the f act that the transfer charge of the transfer position of the image forming station performing image formation is allowed to escape to the adjacent transfer charger through the recording material.

To solve this problem, there has been proposed, for example, a construction in which a mechanism for causing transfer chargers to come in contact with and separate from each other is provided, and in which the transfer charger corresponding to the image forming station whose processing devices are stopped is separated. Similarly, there has been proposed, for example, a construction in which a mechanism for causing recording material bearing member to come in contact with and separate from other components is provided, and in which the portion of the recording material bearing member at a position corresponding to the image forming station whose processing devices are stopped is separated.

However, such constructions involve an increase in the number of parts, an increase in the size of the image forming apparatus main body, and complicated control operations. Further, when, as stated above, the transfer charger or the recording material bearing member is separated, it becomes impossible to properly nip the recording material, and the conveying force for the recording material deteriorates, resulting in color registration error.

SUMMARY OF THE INVENTION

The present invention has been made in view of the above problems in the conventional art. It is accordingly an object of the present invention to provide an image forming apparatus capable of selecting an image forming station for use in an image formation from a plurality of image forming stations, and in the case where image forming stations which perform no image formation exist, to provide an image forming apparatus capable of obtaining a stable transfer characteristic and a satisfactory image independently of environmental conditions such as humidity.

To achieve the above object, there is provided, in accordance with the present invention, an image forming apparatus of the type in which it is possible to select an image forming station for use in an image formation from a plurality of image forming stations, the image forming apparatus comprising:

a plurality of image forming stations each having an image bearing member for bearing a latent image and developing means for developing the latent image on the image bearing member by a developer;

transfer means adapted to come into contact with medium means to induce a charge and to electrostatically transfer developer images formed in the image forming stations to the medium means; and current control means for controlling an electric current flowing through the transfer means, wherein the current control means effects control such that the amount of electric current flowing through the transfer means corresponding to an image forming station not being used for image formation is substantially zero.

DESCRIPTION OF THE PREFERRED EMBODIMENTS

Embodiments of the present invention will now be described with reference to the drawings.

(First Embodiment)

Figure 1:
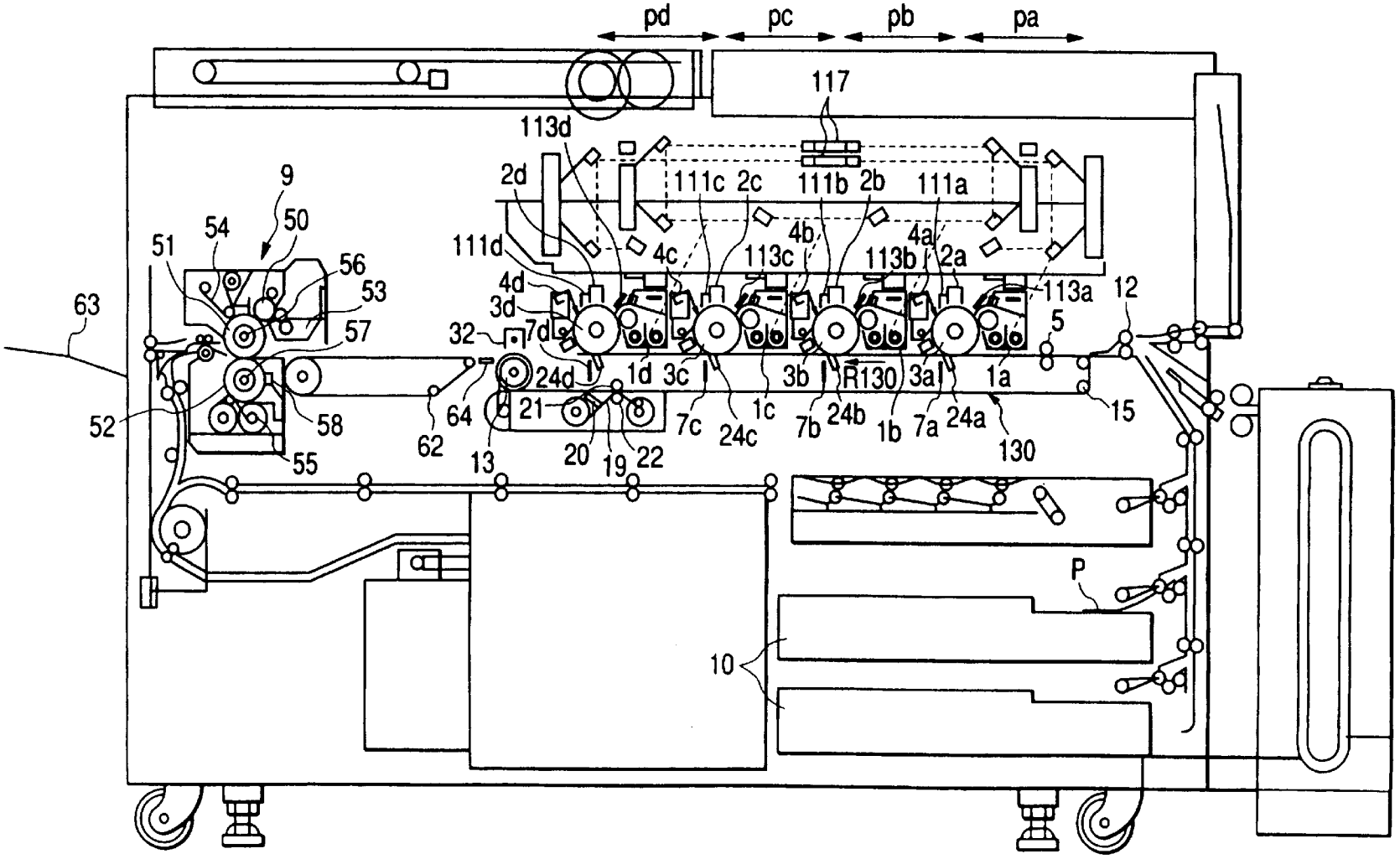
FIG. 1 is a sectional view schematically showing the construction of an image forming apparatus according to a first embodiment of the present invention.
Figure 2:
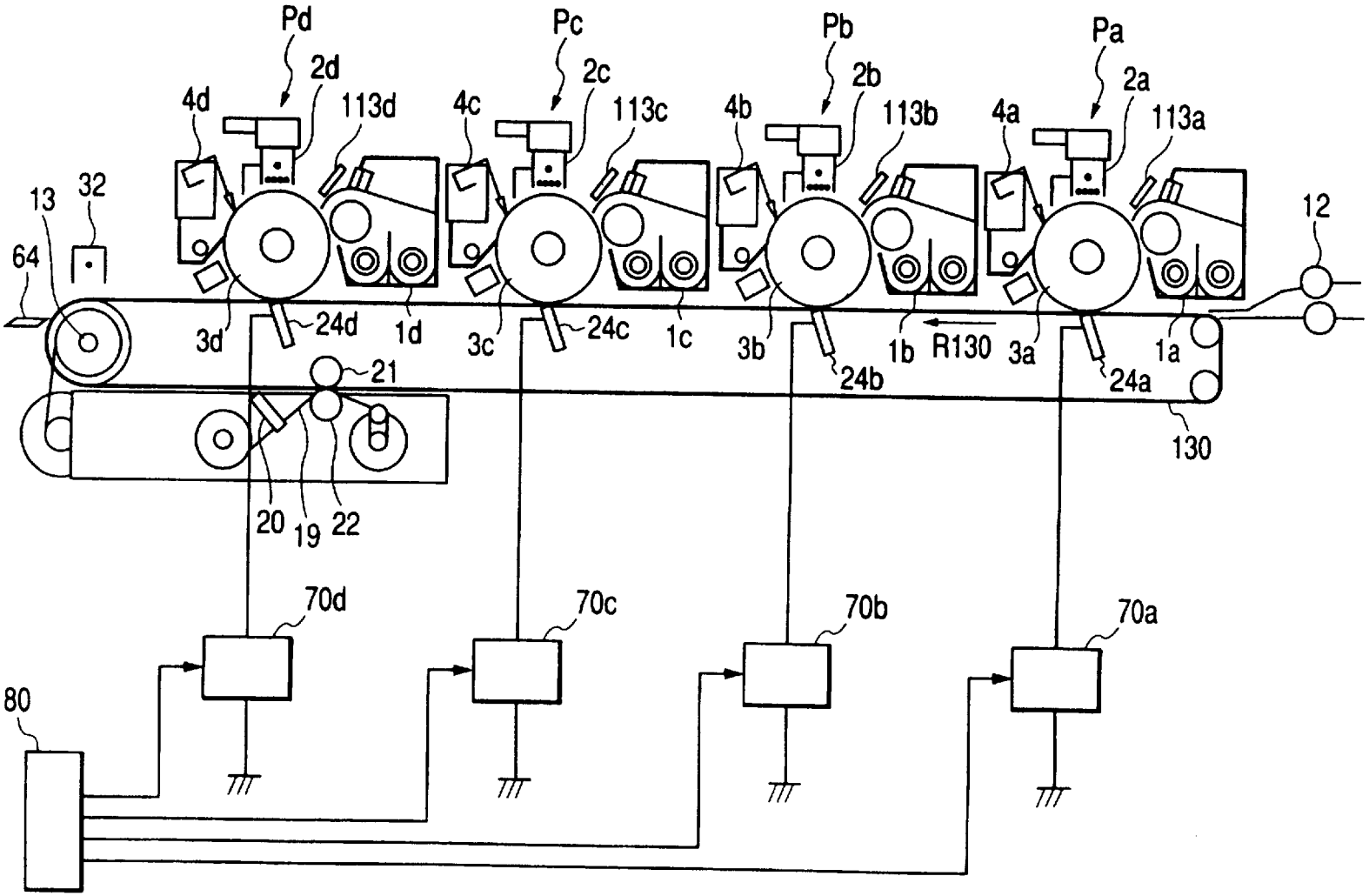
FIG. 2 is an enlarged view of image forming station of the first embodiment.

FIG. 1 shows an image forming apparatus according to an embodiment of the present invention. FIG. 2 is an enlarged view of image forming stations of this image forming apparatus.

The image forming apparatus shown in FIG. 1 is a four-full-color laser printer, which comprises a transfer belt 130 serving as a transfer material bearing member (medium means) for bearing and conveying a recording material P on its surface, and four image forming stations sequentially arranged along the rotating direction of the transfer belt 130 (the direction indicated by an arrow R130) in the order from the upstream side, i.e., a first image forming station Pa (for yellow images), a second image forming station Pb (for magenta images), a third image forming station Pc (for cyan images), and a fourth image forming station Pd (for black images).

In this embodiment, the first through fourth image forming stations Pa, Pb, Pc, and Pd have dedicated image bearing members in the form of drum-shaped electrophotographic photosensitive members (hereinafter referred to as "photosensitive drums") 3*a*, 3*b*, 3*c*, and 3*d*, respectively, toner images of the different colors being formed on the photosensitive drums 3*a*, 3*b*, 3*c*, and 3*d*.

Respectively provided around the photosensitive drums 3*a*, 3*b*, 3*c*, and 3*d* are: exposure lamps 111*a*, 111*b*, 111*c*, and 111*d*; drum chargers (primary chargers) 2*a*, 2*b*, 2*c*, and 2*d*; electrostatic voltmeters 113*a*, 113*b*, 113*c*, and 113*d*; developing devices 1*a*, 1*b*, 1*c*, and 1*d*; transfer chargers 24*a*, 24*b*, 24*c*, and 24*d*; and cleaners 4*a*, 4*b*, 4*c*, and 4*d*. Further, a light source device (not shown) and a polygon mirror 117 are provided in the upper portion of the image forming apparatus main body.

A laser beam emitted from the light source device is scanned by rotating the polygon mirror 117, and the scan beam is deflected by a reflection mirror, and condensed on the generatrices of the photosensitive drums 3*a*, 3*b*, 3*c*, and 3*d* by an fθ lens, whereby electrostatic latent images according to an image signal are formed on the photosensitive drums 3*a*, 3*b*, 3*c*, and 3*d*.

The developing devices 1*a*, 1*b*, 1*c*, and 1*d* are respectively filled with yellow, magenta, cyan, and black toners as developers in predetermined amount by supply devices (not shown). The developing devices 1*a*, 1*b*, 1*c*, and 1*d* develop the electrostatic latent images on the photosensitive drums 3*a*, 3*b*, 3*c*, and 3*d* to visualize them as an yellow toner image, a magenta toner image, a cyan toner image, and a black toner image.

The recording material P is contained in a recording material cassette 10, from which the recording material P is supplied to the transfer belt 130 by way of a feed roller, a plurality of conveying rollers, and registration rollers 12, and are sequentially conveyed to transfer positions opposed to the photosensitive drums 3*a*, 3*b*, 3*c*, and 3*d* by the transfer belt 130.

The transfer belt 130 consists of a dielectric resin sheet, such as a polyethylene terephthalate resin sheet (PET sheet), a polyvinylidene fluoride resin sheet, or a polyurethane resin sheet. The end portions of the sheet are superimposed one upon the other to form an endless configuration, or a belt having no joint (seamless belt) is used. The transfer belt 130 will be further described below.

The transfer belt 130 is rotated by a drive roller 13 and extends around driven roller 15. When it is confirmed that a portion of the transfer belt 130 has reached a predetermined position, the recording material P is conveyed from the registration rollers 12 to the transfer belt 130, and conveyed toward the transfer position of the first image forming station Pa. At the same time, an image write signal is turned ON, and, using the signal as a reference, image formation is performed on the photosensitive drum 3*a* of the first image forming station Pa with a fixed timing. And, at the transfer position below the photosensitive drum 3*a*, the transfer charger 24*a* imparts an electric field or charge, whereby the toner image of the first color formed on the photosensitive drum 3*a* is transferred to the recording material P. As a result of this transfer, the recording material P is firmly held on the transfer belt 130 by electrostatic attractive force, and conveyed to the second image forming station Pb onward. Note that, instead of causing the recording material P to be electrostatically attracted to the transfer belt 130 simultaneously with the transfer, the recording material P may be attracted to the transfer belt by an attracting charger 5 prior to the transfer. As the attracting charger 5, it is possible to use a non-contact charger like a corona discharge device, or a contact charger using a charging member like a blade, roller or brush.

As the transfer charger 24*a*, a contact charger using a transfer charging member like a blade, roller or brush is used. A contact charger is advantageous, for example, in that it is free from ozone and resistant to fluctuation in temperature and humidity, and that it provides high image quality. Further, to stabilize the transfer characteristic, charge eliminating needles 7*a*, 7*b*, 7*c*, and 7*d* may be provided. Though the charge eliminating needles 7*a* through 7*d* are out of contact with the transfer belt 130, the charge eliminating needles 7*a* through 7*d* serve to discharge a part of the transfer current. Due to this construction, it is possible to prevent discharge attributable to uneven charge after the separation of the recording material P from the photosensitive drum.

Image formation and transfer in the second through fourth image forming stations Pb through Pd are performed in the same manner as in the first image forming station Pa. Next, the recording material P to which the toner images of the four colors have been transferred undergoes charge elimination by a separation charger 32 in the downstream portion with respect to the conveying direction of the transfer belt 130, which decays the electrostatic attractive force, with the result that the recording material P is separated from the end portion of the transfer belt 130. In particular, in a low-humidity environment, the recording material P is dried and its electrical resistance increases, so that the electrostatic attractive force with the transfer belt 130 increases, with the result that the effect of the separation charger 32 is enhanced. Usually, the separation charger 32 charges the recording material P before the toner image is fixed. Thus, a non-contact charger is used.

As the output of the separation charger 32, an AC voltage of a peak-to-peak voltage Vpp of 10 kV and a frequency of approximately 500 Hz is used. In some cases, to prevent defective image formation such as scattering of toner, a plus or minus DC component of approximately 100 $\mu$A is superimposed in addition to the above-mentioned AC output.

The recording material P separated from the transfer belt 130 is conveyed to a fixing device 9 by a conveying portion 62. A separation guide 64 serves to stabilize the leading end movement of the recording material P.

The fixing device 9 includes a fixing roller 51, a pressure roller 52, heat-resistant cleaning members 54 and 55 for cleaning these rollers, roller heating heaters 56 and 57 arranged in the fixing roller 51 and the pressure roller 52, an application roller 50 for applying a mold release agent oil such as dimethyl silicone oil to the fixing roller 51, a reservoir 53 for the oil, and a thermistor 58 for detecting the temperature of the surface of the pressure roller 52 and controlling the fixing temperature.

The recording material P, to which the toner images of the four colors have been transferred, undergoes a color mixture of toner images and a fixation of the image to the recording material P by the fixing operation, with the result that a full color image is formed, and the recording material P is discharged onto a discharge tray 63.

After the completion of transfer operation, any toner remaining on the photosensitive drums 3*a*, 3*b*, 3*c*, and 3*d* is removed by the cleaners 4*a*, 4*b*, 4*c*, and 4*d* for next image forming operation. Any toner remaining on the transfer belt 130 and other foreign matter are removed by a cleaning blade 20 and a cleaning web (non-woven fabric) 19 which are held in contact with the surface of the transfer belt 130.

Further, in the cleaner portion, the charge of the transfer belt 130 remaining after the separation of the recording material P is removed by grounded charge eliminating rollers 21 and 22. It is also possible to apply a high voltage of approximately 2 to 4 kV to the charge eliminating roller 21, whereby not only does the transfer belt 130 undergo charge elimination, but also is charged in opposite potential, so that the potential of the transfer belt when the transfer is completed is low.

As stated above, the transfer belt 130 used in the image forming apparatus, constructed as described above, consists of a dielectric sheet. such as a PET sheet, a polyvinylidene fluoride sheet, or a polyurethane sheet, generally having a volume resistivity of $10^{13}$ to $10^{18}$ Ω·cm. Further, it is known that, when the current imparted by the transfer charging means at the time of transfer is constant and appropriate, the image is stabilized. In view of this, constant current control is generally performed so that a constant current may be obtained even when the value of volume resistivity varies due to the type of the recording material P (thickness, material, etc.), moisture absorption condition, etc.

In the above-described image forming apparatus, when the image to be formed is a full-color image, yellow, magenta, cyan, and black toner images are sequentially formed, as stated above. In the case of a monochrome image, only a black toner image is formed, and the operation of at least one of the primary charger (charging means) and the developing device (developing means) is stopped with respect to colors which are not used for image formation. In this way, the deterioration in the primary charger, developing device, developer, etc. and the flaws on the photosensitive drum are mitigated, thereby achieving a long service life. It is also possible, for example, to detect the color feature of the original image beforehand, and to stop the developing devices in the image forming stations for one, two or three colors which are not used for image formation.

However, the existence of image forming stations which do not perform image formation results in a defective image due to memory on the photosensitive drum caused by transfer charging and an increase in the transfer belt potential when the transfer chargers for all colors are operated as in the case of full-color image formation.

When there are image forming stations which do not perform image formation, such defective image formation might be avoided by grounding the corresponding transfer chargers. However, that will lead to defective transfer in a high-humidity environment. This arises from the fact that the transfer charge at the transfer position is allowed to escape to the adjacent transfer charger through the recording material P.

In the present invention, the above problem is solved as follows.

Apart from the above-mentioned ones, examples of the dielectric sheet material for the transfer belt 130 generally used include film-shaped sheets of engineering plastics, such as polyacetal, polyamide, polyvinyl alcohol, polyether ketone, polystyrene, polybutylene terephthalate, polymethyl pentene, polypropylene, polyethylene, polyphenelyne sulfide, polyurethane, silicone resin, polyamide imide, polycarbonate, polyphenylene oxide, polyether sulfone, polysulfone, aromatic polyester, polyether imide, and aromatic polyimide. In this embodiment, polyimide resin is used from the viewpoint of mechanical characteristics, electrical characteristics, incombustibility, etc. The sheet used is a seamless type sheet having a volume resistivity of $10^{16}$ Ω·cm and a thickness of 10 μm. The transfer chargers 24*a*, 24*b*, 24*c*, and 24*d* are formed of rectangular plate-shaped conductive rubber members extending in a direction (hereinafter referred to as "thrust direction") perpendicular to the direction (indicated by the arrow R130) in which the recording material P is conveyed. The plate-shaped conductive rubber members are urged so as to be in contact with the photosensitive drums 3*a*, 3*b*, 3*c*, and 3*d* through the transfer belt 130. Due to these transfer chargers 24*a* through 24*d*, charging is effected, in this embodiment, in positive polarity from the back surface of the recording material P conveyed to the transfer position, i.e., in a polarity opposite to that of the toner, which is of negative polarity, whereby the toner images on the photosensitive drums 3*a* through 3*d* are electrostatically transferred to the front surface of the recording material P. In this embodiment, constant current control is effected, and the transfer current is 12 μA. A monochrome original is used as a source document, and a monochrome copy is output. In this case, no image formation is performed in the image forming stations Pa, Pb, and Pc for yellow, magenta, and cyan, and the primary chargers 2*a*, 2*b*, and 2*c*, the developing devices 1*a*, 1*b*, and 1*c*, etc. are not operating.

In the above-described construction, grounding was effected, with the transfer current of the black transfer charger 24*d* being 12 μA and no transfer current flowing through the yellow, magenta, and cyan transfer chargers 24*a*, 24*b*, and 24*c*, with the result that the transfer current for black flowed into the cyan transfer charger 24*c* instead of flowing to the photosensitive drum 3*d* for black, resulting in defective image formation. At this time, the current flowed into the cyan transfer charger 24*c* was 3 μA.

In view of this, control was effected on transfer current output power sources 70*a*, 70*b*, and 70*c* by control means 80 such that the transfer current allowed to flow into the yellow, magenta, and cyan transfer chargers 24*a*, 24*b*, and 24*c* became 0 μA. This made it possible to obtain a satisfactory image, without allowing the black transfer current to flow into the cyan transfer charger 24*c*.

Not only in the case of monochrome image formation, but also in the case of image formation in two or three colors, a satisfactory image was obtained by effecting constant current control such that the transfer current of the transfer chargers corresponding to the image forming stations performing no image formation was 0 μA. Note that Substantially the same effect was achieved by using conductive brushes or conductive rollers as the transfer chargers 24*a*, 24*b*, 24*c*, and 24*d* instead of conductive blades.

Although the current control value in the transfer means corresponding to the image forming station performing no image formation is most preferably 0 μA, the effect of the present invention can also be achieved with a current control value of approximately 0 μA as long as it is within the range which does not involve defective transfer due to the escape of transfer charge.

(Second Embodiment)

Figure 3:
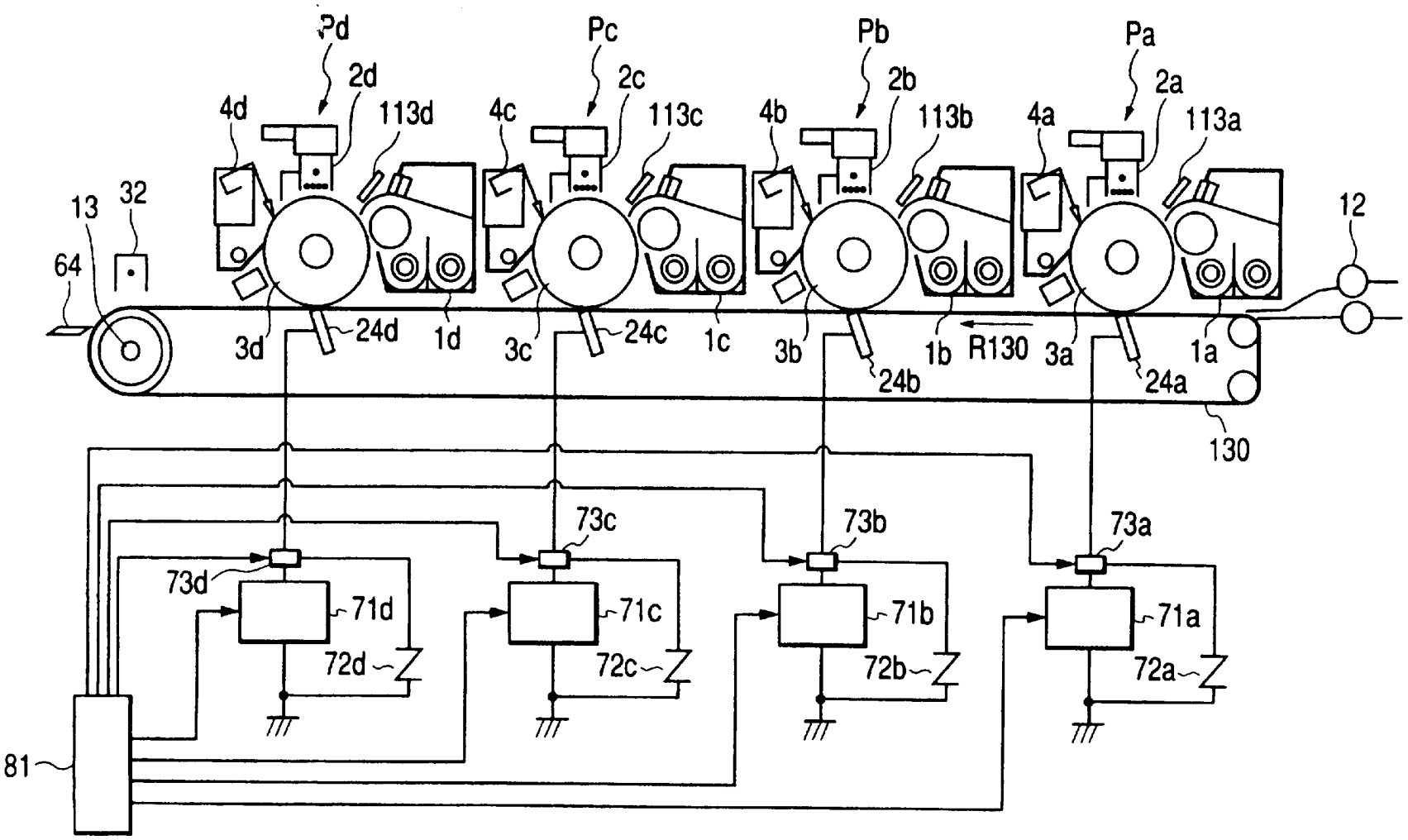
FIG. 3 is a sectional view schematically showing the construction of an image forming apparatus according to a second embodiment of the present invention.

FIG. 3 shows a second embodiment of the present invention. In this embodiment, in addition to the construction of the first embodiment described above, predetermined-withstand-voltage varistors (non-linear elements) 72*a,* 72*b,* 72*c,* and 72*d* are connected to the transfer chargers in addition to transfer current output power sources 71*a,* 71*b,* 71*c,* and 71*d.* When no image formation is performed, the connection of the transfer chargers is switched from the transfer current output power sources 71*a* through 71*d* to the varistors 72*a* through 72*d* by switches 73*a,* 73*b,* 73*c,* and 73*d,* which serve as switching means, to vary impedance, whereby no transfer charge is allowed to flow from the portion where image formation is being performed. From the result of examination, the withstand voltage of the varistors 72*a* through 72*d* was determined as follows. When the maximum value of the output voltage of the transfer chargers in the case of three-color image formation was, for example, 6 kV, the withstand voltage of the varistors 72*a* through 72*d* was settled on 6 kV.

In the construction of this embodiment, when performing monochrome image formation, the transfer current of the transfer charger 24*d* for black is set to 12 μA and switching of the switches 73*a,* 73*b,* and 73*c* is conducted by control means 81 such that connection is effected from the transfer current power sources for the yellow, magenta, and cyan transfer chargers 24*a,* 24*b,* and 24*c* to the varistors 72*a,* 72*b,* and 72*c.*

Due to this construction, a satisfactory image was obtained without the black transfer current being allowed to flow into the cyan transfer charger. A satisfactory image was obtained not only in monochrome image formation, but also in color formation in two or three colors by switching the connection of the transfer charger corresponding to the image forming station for the color in which no image formation is to be performed from the transfer current output power source to the varistor. Substantially the same effect as described above was obtained in the case in which conductive brushes or conductive rollers were used as the transfer chargers 24*a,* 24*b,* 24*c,* and 24*d* instead of the conductive blades. Further, as the nonlinear elements, it is also possible to adopt Zener diodes instead of the varistors.

(Third Embodiment)

Next, a third embodiment of the present invention will be described with reference to FIGS. 4 and 5. In this embodiment, the present invention is applied to an image forming apparatus provided with an intermediate transfer belt serving as an intermediate transfer member (medium means).

First, with reference to FIG. 4, the general construction and function of the image forming apparatus of this embodiment will be described.

The image forming apparatus of this embodiment is provided with an intermediate transfer belt 190 serving as an intermediate transfer member stretching around a driving roller 112*a,* a driven roller 112*b,* and a secondary transfer opposite roller 112*c* and adapted to run in the direction indicated by the arrow X. Above the flat portion of the transfer belt, image forming stations Pa, Pb, Pc, and Pd are arranged in series.

The image forming stations Pa through Pd are adapted to form magenta, cyan, yellow, and black toner images, respectively.

In the magenta image forming station Pa, a primary charger 102*a,* a developing device 103*a* and a cleaner 104*a* are provided around a photosensitive drum 101*a.* The other image forming stations Pb through Pd have primary chargers 102*b*–102*d,* developing devices 103*b*–103*d,* and cleaners 104*b*–104*d,* respectively, each provided around respective photosensitive drums 101*b*–101*d.* Imaging devices 110*a*–110*d* project a latent image on photosensitive drums 101*a*–101*d,* respectively.

Upon reaching the primary transfer position where the photosensitive drum 101*a,* abuts the intermediate transfer belt 190, a magenta toner image is transferred to the intermediate transfer belt 190 by a first transfer bias applied by a primary transfer device 105*a* serving as the primary transfer charging means. When the intermediate transfer belt 190 bearing the magenta toner image is conveyed to the next image forming station Pb, a cyan toner image which has been formed by this time on the photosensitive drum 101*b* in the image forming station Pb in the same process as described above is transferred to the magenta toner image.

Similarly, as the transfer belt advances to the image forming stations Pc and Pd, a yellow toner image and a black toner image are superimposed and transferred onto the above toner image in the respective transfer positions. No later than this time, the recording material P fed from a feed cassette 106 by a feed roller 107 reaches registration rollers 108, and further, in synchronism with the toner image, is conveyed to the secondary transfer position formed by the secondary transfer opposite roller 112*c* and a secondary transfer device 140 serving as the secondary transfer charging means. There, the above-mentioned four-color toner image is transferred to the recording material P by a transfer bias applied to the secondary transfer device 140. The recording material P is further conveyed to a fixing device 111, where heat and pressure are applied to the recording material, whereby the toner image is fixed to the recording material, which is discharged to the exterior of the apparatus.

The toner remaining on the intermediate transfer belt 190 after the image transfer to the recording material P is collected by a cleaning device 113. The cleaning device 113 is provided with a cleaning blade 115 formed, for example, of polyurethane rubber. The edge of the cleaning blade 115 is held in contact with the intermediate transfer belt 190 to remove the toner adhering thereto by scraping it off.

Figure 4:
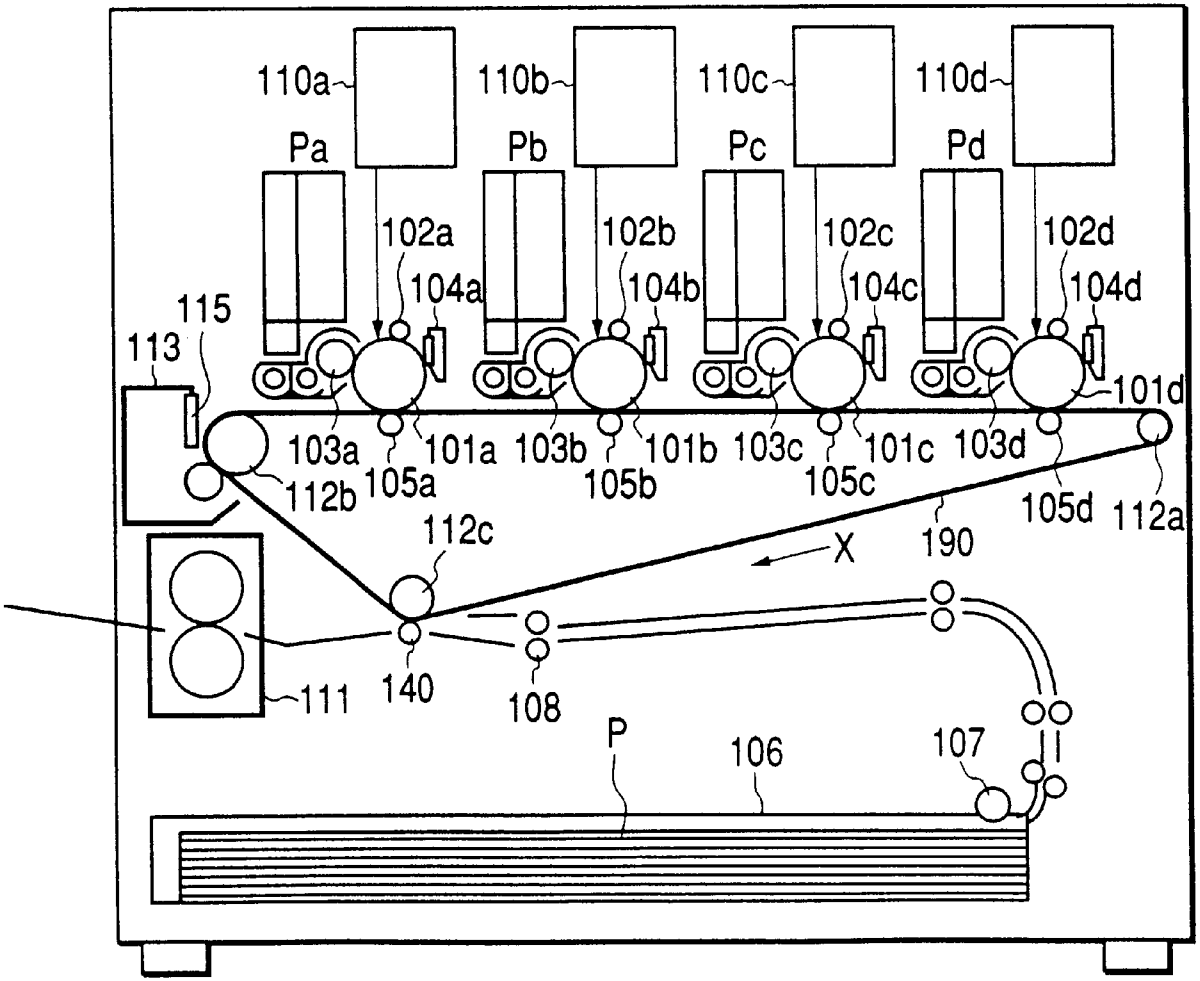
FIG. 4 is a sectional view schematically showing the construction of an image forming apparatus according to a third embodiment of the present invention.
Figure 5:
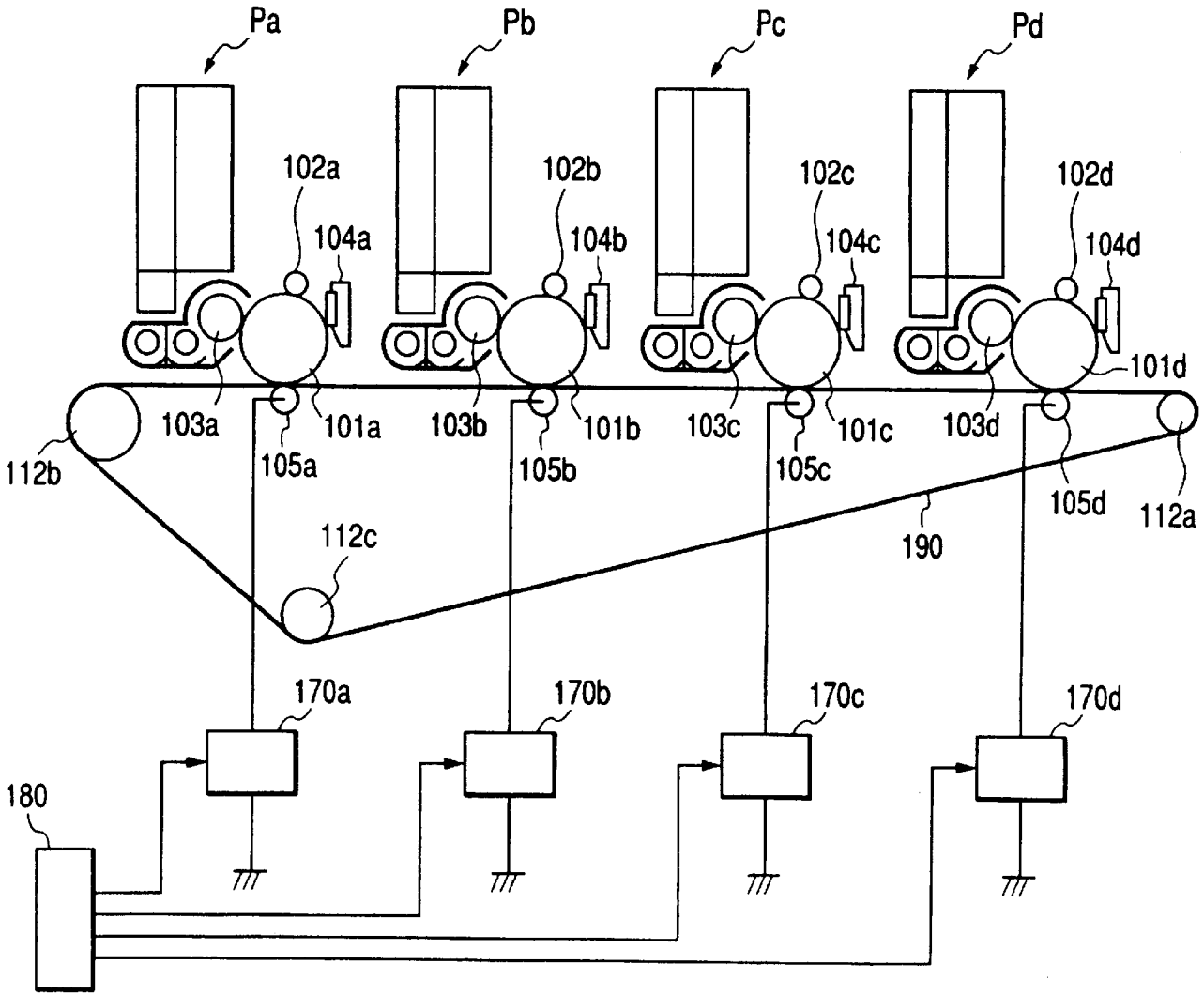
FIG. 5 is an enlarged view of image forming station of the third embodiment.

FIG. 5 is an enlarged view of the image forming stations of the image forming apparatus shown in FIG. 4.

In the primary transfer positions of this embodiment, conductive transfer rollers 105*a,* 105*b,* 105*c,* and 105*d* as transfer means are used. Transfer power sources 170*a,* 170*b,* 170*c,* and 170*d* are respectively connected to the transfer rollers, and the outputs of these transfer power sources are controlled by control means 180.

In this image forming apparatus constructed as described above, when, for example, a monochrome copy is to be output, image formation is not conducted in the magenta, cyan, and yellow image forming stations Pa, Pb, and Pc, and the primary chargers 102*a* through 102*c,* and the developing devices 103*a* through 103*c* are not operating.

And, control is effected such that the transfer current of the black transfer means 105*d* is, for example, 10 μA and that the current flowing through the magenta, cyan, and yellow transfer means 105*a* through 105*c* is 0 μA. This made it possible to obtain a satisfactory image, without allowing the black transfer current to flow into the adjacent yellow transfer means 105*c.*

Further, not only in monochrome image formation, but also in image formations in two and three colors, a satisfactory image was obtained by effecting control such that the transfer current of the transfer charger corresponding to the image forming station for the color in which no image formation is performed is 0 μA. Further, substantially the same effect as described above was obtained also in the case in which, instead of the conductive rollers, conductive brushes or conductive blades were used as the transfer chargers 24*a,* 24*b,* 24*c,* and 24*d.*

Although it is most desirable that the current control value in the transfer means corresponding to the image forming station performing no image formation be 0 μA, the effect of the present invention can be achieved when the value is approximately 0 μA as long as it is in the range which does not involve defective transfer due to the escape of the transfer charge.

(Fourth Embodiment)

Figure 6:
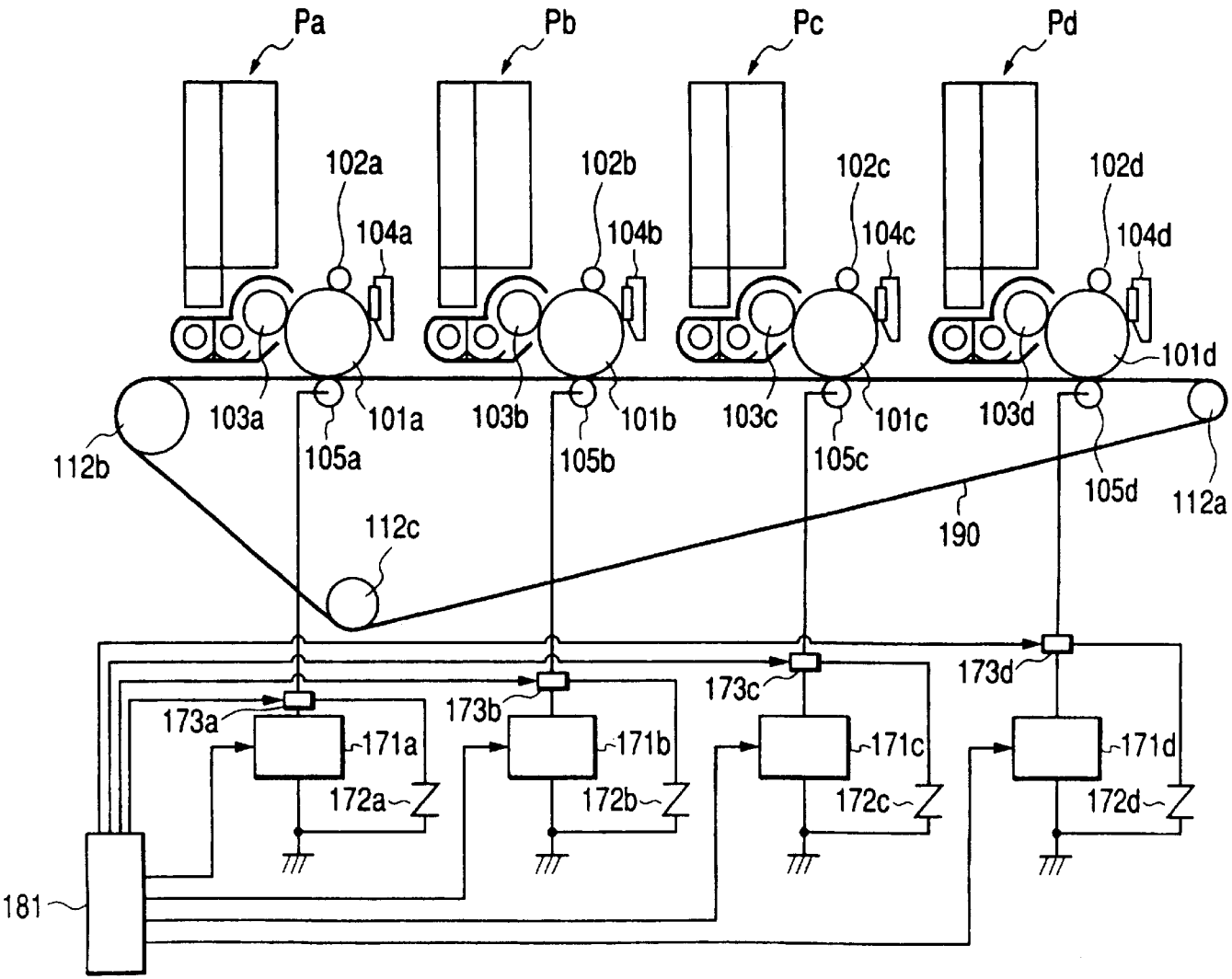
FIG. 6 is a sectional view of an image forming apparatus according to a fourth embodiment of the present invention.

FIG. 6 shows the fourth embodiment of the present invention. In this embodiment, in addition to the construction of the third embodiment, there are connected, in addition to the transfer current output power sources 171*a,* 171*b,* 171*c,* and 171*d,* varistors (non-linear elements) 172*a,* 172*b,* 172*c,* and 172*d* having, for example, a predetermined withstand voltage. When no image formation is performed, the connection of the transfer chargers is switched by switches 173*a,* 173*b,* 173*c,* and 173*d,* serving as switching means, from the transfer current output power source 171*a* through 171*d* to the varistors 172*a* through 172*d* to vary impedance, preventing transfer current from flowing out from the portion where image formation is being performed. The switching of the switching means 173*a* through 173*d* and the transfer power sources 171*a* through 171*d* are controlled by control means 181. When the maximum value of the output voltage of the transfer chargers in the case of three-color image formation was 6 kV, the withstand voltage of the varistors 172*a* through 172*d* was also settled on the maximum value of 6 kV.

In the construction of this embodiment, when performing monochrome image formation, the control means 181 effects control such that the transfer current of the transfer charger 105*d* is set to 10 μA and that switching is effected from the transfer current power sources for the magenta, cyan, and yellow transfer chargers 105*a* through 105*c* to the varistors.

Due to this construction, a satisfactory image was obtained without the black transfer current being allowed to flow into the cyan transfer charger. A satisfactory image was obtained not only in single-color image formation, but also in color formation in two or three colors by switching the connection of the transfer charger corresponding to the image forming station for the color in which no image formation is to be performed, from the transfer current output power source to the varistor. Substantially the same effect described above was obtained in the case in which, instead of the conductive rollers, conductive brushes or conductive blades were used as the transfer chargers 105*a,* 105*b,* 105*c,* and 105*d.* Further, as the non-linear elements, it is also possible to adopt Zener diodes instead of the varistors.

What is claimed is:

1. An image forming apparatus in which an image forming station for use in an image formation from a plurality of image forming stations is selectable, the image forming apparatus comprising:

the plurality of image forming stations each having an image bearing member for bearing a latent image and developing means for developing the latent image on the image bearing member by a developer;

transfer means being in contact with medium means to give a charge to the medium means to electrostatically transfer developer images formed in the plurality of image forming stations to the medium means; and current control means for controlling an electric current flowing through the transfer means, wherein the current control means controls the electric current so that an amount of electric current flowing through the transfer means corresponding to an image forming station not being used for the image formation is substantially zero.

2. An image forming apparatus according to claim 1, wherein the current control means comprises a power source for imparting the electric current to the transfer means and power source control means for controlling the power source.

3. An image forming apparatus according to claim 1, wherein the current control means comprises a power source for imparting the electric current to the transfer means, a non-linear element having a predetermined withstand voltage, and switching means for switching between the power source and the non-linear element.

4. An image forming apparatus according to claim 3, wherein the transfer means corresponding to the image forming station not being used for the image formation is to be connected to the non-linear element.

5. An image forming apparatus according to claim 3 or 4, wherein the predetermined withstand voltage is set to a value corresponding to a maximum output voltage of the power source.

6. An image forming apparatus according to claim 3 or 4, wherein the non-linear element is a varistor or a Zener diode.

7. An image forming apparatus according to claim 1, wherein the medium means is a transfer material bearing member for bearing and conveying a transfer material onto which developer images of the plurality of image forming stations are directly transferred.

8. An image forming apparatus according to claim 1, wherein the medium means is an intermediate transfer member onto which developer images of the plurality of image forming stations are directly transferred.

9. An image forming apparatus in which an image forming station for use in an image formation from a plurality of image forming stations is selectable, the image forming apparatus comprising:

the plurality of image forming stations each having an image bearing member for bearing a latent image and developing means for developing the latent image on the image bearing member by a developer;

a transfer material bearing member for bearing and conveying a transfer material onto which developer images of the plurality of image forming stations are sequentially and electrostatically transferred;

transfer means being in contact with the transfer material bearing member to give a charge to the transfer material bearing member;

a power source for applying a voltage to the transfer means; and control means for controlling output of the power source so that a value of an electric current flowing through transfer means corresponding on an image forming station not being used for the image formation is substantially zero.

10. An image forming apparatus according to claim 9, wherein the transfer material bearing member is in a form of a belt.

11. An image forming apparatus according to claim 9, wherein the transfer means has conductivity and has a blade-shaped, brush-shaped, or roller-shaped configuration.

12. An image forming apparatus according to claim 9, wherein each of the plurality of image forming stations has charging means for charging the image bearing member, and wherein, in the image forming station not being used for the image formation, at least the charging means or the developing means is not operated.

13. An image forming apparatus in which an image forming station for use in an image formation from a plurality of image forming stations is selectable, the image forming apparatus comprising:

the plurality of image forming stations each having an image bearing member for bearing a latent image and developing means for developing the latent image on the image bearing member by a developer;

a transfer material bearing member for bearing and conveying a transfer material onto which developer images of the plurality of image forming stations are sequentially and electrostatically transferred;

transfer means being in contact with the transfer material bearing member to give a charge to the transfer material bearing member;

a power source for applying a voltage to the transfer means;

a non-linear element having a predetermined withstand voltage and connected to the transfer means so as to be electrically parallel to the power source;

switching means for switching between the power source and the non-liner element; and control means for controlling the switching means so that transfer means corresponding to an image forming station not being used for the image formation is connected to the non-linear element.

14. An image forming apparatus according to claim 13, wherein the predetermined withstand voltage is set at a value corresponding to a maximum output voltage of the power source.

15. An image forming apparatus according to claim 13, wherein the non-linear element is a varistor or a Zener diode.

16. An image forming apparatus according to claim 13, wherein the transfer material bearing member is in a form of a belt.

17. An image forming apparatus according to claim 13, wherein the transfer means has conductivity and has a blade-shaped, brush-shaped, or roller-shaped configuration.

18. An image forming apparatus according to claim 13, wherein each of the plurality of image forming stations has charging means for charging the image bearing member, and wherein, in the image forming station not being used for the image formation, at least the charging means or the developing means is not operated.

19. An image forming apparatus in which an image forming station for use in an image formation from a plurality of image forming stations is selectable, the image forming apparatus comprising:

the plurality of image forming stations each having an image bearing member for bearing a latent image and developing means for developing the latent image on the image bearing member by a developer;

an intermediate transfer member onto which developer images of the plurality of image forming stations are sequentially and electrostatically transferred;

transfer means being in contact with the intermediate transfer member to give a charge to the intermediate transfer member;

a power source for applying a voltage to the transfer means; and control means for controlling output of the power source so that a value of an electric current flowing through transfer means corresponding to an image forming station not being used for the image formation is substantially zero.

20. An image forming apparatus according to claim 19, wherein the intermediate transfer member is in a form of a belt.

21. An image forming apparatus according to claim 19, wherein the transfer means has conductivity and has a blade-shaped, brush-shaped, or roller-shaped configuration.

22. An image forming apparatus according to claim 19, wherein each of the plurality of image forming stations has charging means for charging the image bearing member, and wherein, in the image forming station not being used for the image formation, at least the charging means or the developing means is not operated.

23. An image forming apparatus in which an image forming station for use in an image formation from a plurality of image forming stations is selectable, the image forming apparatus comprising:

the plurality of image forming stations each having an image bearing member for bearing a latent image and developing means for developing the latent image on the image bearing member by a developer;

an intermediate transfer member onto which developer images of the plurality of image forming stations are sequentially and electrostatically transferred;

transfer means being in contact with the intermediate transfer member to give a charge to the intermediate transfer member;

a power source for applying a voltage to the transfer means;

a non-linear element having a predetermined withstand voltage and connected to the transfer means so as to be electrically in parallel with the power source;

switching means for switching between the power source and the non-linear element; and control means for controlling the switching means so that transfer means corresponding to the image forming station not being used for the image formation is connected to the non-linear element.

24. An image forming apparatus according to claim 23, wherein the predetermined withstand voltage is set at a value corresponding to a maximum output voltage of the power source.

25. An image forming apparatus according to claim 23, wherein the non-linear element is a varistor or a Zener diode.

26. An image forming apparatus according to claim 23, wherein the intermediate transfer member is in a form of a belt.

27. An image forming apparatus according to claim 23, wherein the transfer means has conductivity and has a blade-shaped, brush-shaped, or roller-shaped configuration.

28. An image forming apparatus according to claim 23, wherein each of the plurality of image forming stations has charging means for charging the image bearing member, and wherein, in the image forming station not being used for the image formation, the charging means or the developing means is not operated.

* * * * *

UNITED STATES PATENT AND TRADEMARK OFFICE

CERTIFICATE OF CORRECTION

PATENT NO. : 6,442,356 B2
DATED : August 27, 2002
INVENTOR(S) : Haruhiko Oamta et al.

It is certified that error appears in the above-identified patent and that said Letters Patent is hereby corrected as shown below:

Column 2,
Line 65, "station" should read -- stations --.

Column 9,
Line 54, "described" should read -- as described --.

Signed and Sealed this

Fourth Day of February, 2003

JAMES E. ROGAN
*Director of the United States Patent and Trademark Office*